United States Patent [19]

Joshi

[11] Patent Number: 4,725,346

[45] Date of Patent: Feb. 16, 1988

[54] ELECTROLYTE ASSEMBLY FOR OXYGEN GENERATING DEVICE AND ELECTRODES THEREFOR

[75] Inventor: Ashok V. Joshi, Salt Lake City, Utah

[73] Assignee: Ceramatec, Inc., Salt Lake City, Utah

[21] Appl. No.: 889,214

[22] Filed: Jul. 25, 1986

[51] Int. Cl.[4] ..... C25B 1/02; C25B 9/00

[52] U.S. Cl. ..... 204/242; 204/129; 204/130; 204/277; 204/278; 204/421; 204/424; 204/427; 429/30

[58] Field of Search ..... 204/15, 421–429, 204/242, 130, 275–278, 129; 429/30–33, 104

[56] References Cited

U.S. PATENT DOCUMENTS

| | | | |
|---|---|---|---|
| Re. 28,792 | 4/1976 | Ruka et al. | 204/427 |
| 3,481,855 | 12/1969 | Kolodney et al. | 204/422 |
| 4,547,281 | 10/1985 | Wang et al. | 204/426 |

OTHER PUBLICATIONS

Subbarao, "Solid Electrolytes & Their Applications", 1982, pp. 40, 47, 48.

*Primary Examiner*—T. Tung

*Attorney, Agent, or Firm*—Trask, Britt & Rossa

[57] ABSTRACT

An electrochemical oxygen generating device employing oxygen-conducting metal oxide electrolyte and a silver or silver alloy containing non-porous electrode is disclosed.

10 Claims, 3 Drawing Figures

ELECTROLYTE ASSEMBLY FOR OXYGEN GENERATING DEVICE AND ELECTRODES THEREFOR

BACKGROUND OF THE INVENTION

1. Field

This invention generally relates to oxygen generating devices and particularly to electrochemical oxygen generating devices using metal oxide, oxygen ion conducting electrolyte.

2. Prior Art

Electrochemical devices which employ oxygen ion conducting electrolytes are well known. Such devices are used as sensors whereby the oxygen partial pressure difference existing between opposite sides of said electrolyte create a voltage potential which may be determined to indicate a level of oxygen concentration on one side or the other, especially when the oxygen concentration on one side of the sensor is known. Such sensors used in automobile engines, furnaces and other devices wherein it is desired to operate at stochiometric ratios between the fuel and the air or oxygen necessary for combustion of fuel.

Also, such electrochemical devices, when operated in a current mode with an applied voltage may be utilized to generate pure oxygen. Devices of this type are discussed in certain patents to Ruka.

Certain difficulties have generally been encountered with such oxygen sensors and oxygen generating devices. In electrochemical sensors it is common practice to utilize platinum as an electrode or to utilize various electrode layers, for example, a platinum electrode adjacent to the electrolyte with an overcoating of a protective porous film. Platinum has been generally employed because of its catalytic activity and because of its relatively high melting point among conductive metals. It has been found, however, that the use of platinum in oxygen generating electrochemical cells that the platinum, which is relatively conductive, has an apparent resistance higher than what would normally be expected. Thus, oxygen generating electrochemical cells utilizing platinum electrodes have been electrically inefficient. Furthermore, since the platinum electrodes must be porous in order to permit oxygen molecules to reach the surface of the electrolyte at the cathodes, and, upon recombination at the anode surface, to depart from the electrolyte. While pores are thus necessary, the effective electrode-electrolyte interface for electrical purposes is consequently reduced

SUMMARY OF THE INVENTION

The instant invention relates to electrolyte assemblies for electrochemical oxygen generating devices and particularly to an assembly which utilizes silver or silver alloy electrodes. The electrolyte in such devices is typically zirconia, hafnia, ceria or bismuth oxide.

DESCRIPTION OF INVENTION

An electrically efficient oxygen generating device has been invented. The invention particularly relates to an electrolyte cell assembly for such an oxygen generating device and particularly to the electrodes used in such a cell assembly.

An efficient electrochemical oxygen generating device, as described herein, employs an electrolyte cell assembly comprising a zirconia, hafnia, ceria or bismuth oxide electrolyte which is substantially impervious to gas molecules, said electrolyte having a pair of surfaces which are substantially parallel, said surfaces either being cylindrical, planer or other convenient shape, in which the electrolyte surfaces have a coating of a substantially non-porous electrode material of silver or silver alloy containing substantial quantities of silver. The silver or silver containing electrodes may be substantially non-porous inasmuch as silver is pervious to oxygen molecules.

Further description of the invention may be facilitated by reference to the attached drawings.

Figure 1:
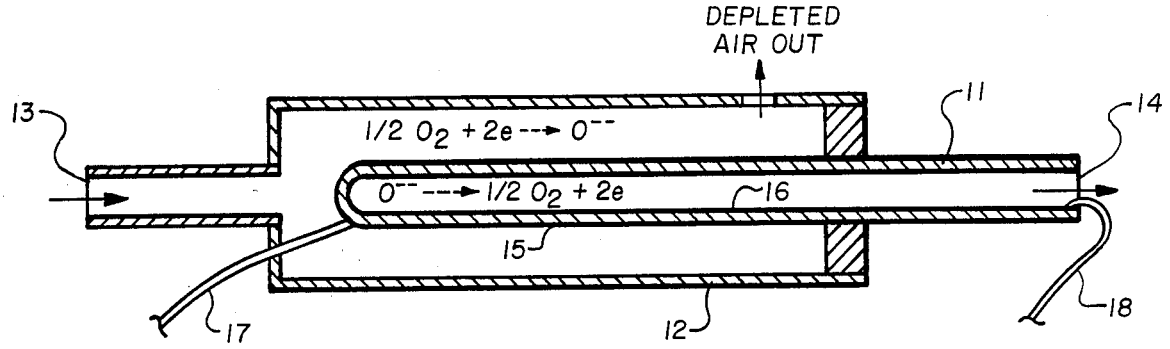
FIG. 1 is a schematic view of an electrochemical oxygen generating device.

FIG. 1 illustrates a portion of an electrochemical oxygen generating device which has a tubular electrolyte 11 residing within a sealed enclosure 12 having an air inlet 13 and a oxygen outlet 14. Substantial portions of the electrolyte tube 11 surfaces contained within the sealed enclosure 12 is coated on its external surface with an electrode 15 and on its internal surface with another electrode 16. Current is introduced to the external electrode 15 by conductor lead 17 and to the interior electrode by conductor lead 18. Thus, by applying a voltage to the conductor leads a current may be caused to pass through the wall of the electrolyte 11. The current carrying means are oxygen ions. The reaction of the oxygen is illustrated in FIG. 1.

At the interfaces between external electrode 15 (cathode) and the electrolyte, oxygen dissociates by the addition of electrons into ions of oxygen. At the internal interface of the electrolyte and internal electrode (anode) the oxygen ions recombine to produce a molecule of oxygen which then diffuses through the silver containing anode to be discharged from the tube at outlet 14.

A characteristic of the electrolytes identified herein is that they are substantially impervious to nitrogen and oxygen molecules. Thus, the electrolyte is a solid, substantially non-porous, impervious material, which under the influence of electrical voltage causes current to pass through the electrolyte wall to cause oxygen ions to migrate from one electrolyte surface to the other.

The conductors, i.e., electrodes utilized in the instant invention are silver, alloys of silver and composites of silver and oxide ion conductive materials. Preferably such alloys and composites contain a very high portion of silver e.g. at least about 50% silver in addition to such other conductive materials combined with the silver. Other metals which may be alloyed with silver to create useful electrodes for purposes of the instant invention are palladium, platinum, gold and copper. Also, certain conductive ceramic oxides may be alloyed with the silver, an example of such a ceramic material being lanthanum strontium, and magnatite.

Silver and alloys of silver containing substantial proportions of silver are particularly effective electrodes for oxygen generating devices. To generate oxygen efficiently and abundantly per unit area of electrolyte surface it is desired that the maximum number of oxygen molecules be present at the cathode-electrolyte interface. Also, from an electrical standpoint, it is desired that each unit area of electrolyte surface be in intimate electrical contact with an equivalent unit area of electrode to maximize the number of ions available per unit area. Silver not silver alloy electrodes, especially at the temperatures utilized in oxygen generating devices, for example, about 500° C. up to about 800° C., have a high diffusitity coefficient for oxygen molecules. Thus, the electrical electrode-electrolyte contact area need not be reduced by the presence of a large preparation of pores, as is necessary for platinum and other conductive metals, in order to maximize the presence of oxygen molecules at the electrolyte-electrode interfaces.

Figure 2:
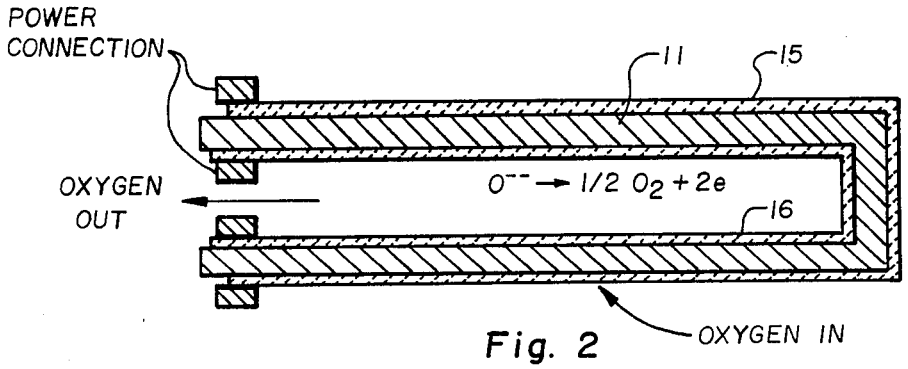
FIG. 2 is a schematic view of an electrolyte cell assembly of electrochemical generating device.

In FIG. 2 an electrolyte cell assembly is illustrated in which an electrolyte 11 is coated with an outer electrode 15 and an inner electrode 16. These electrodes may be of the same or slightly different compositions. For example, the external electrode may be of pure silver while the internal electrode may be of a alloy or such compositions may be reversed. These electrodes are usually applied in thickness of about 1 micron to about 20 microns or more and preferably from about 6 microns to 12 microns. Also, it is generally desired to have the electrodes substantially coextensive with one another; that is, the area of the external electrode coating is substantially the same as is the internal electrode. Also, since silver and silver alloys are pervious (permeable) to gaseous oxygen, the electrodes are preferably substantially continuous, substantially non-porous and substantially uniform in thickness.

It may be desirable in certain instances to provide a protective outer coating for the electrodes. Such coatings may be ceramic or oxide semiconductive materials such as lanthanam strontium, magnatite and other similar corrosion resistant materials. Such protective coating materials are porous to permit gaseous oxygen to pass there through.

Figure 3:
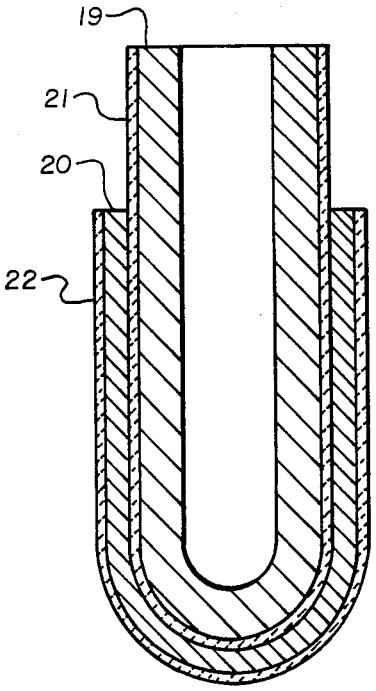
FIG. 3 is a schematic of an electrolyte cell assembly utilizing a very thin walled, electrolyte cell assembly.

Another cell assembly is illustrated in FIG. 3. A porous ceramic substrate 19 is a primary structural member of this particular cell inasmuch as the electrolyte 20 is a very thin material which would be non-self supporting or, if self supporting, very fragile if it were not for the main structural porous ceramic substrate 19. The thin electrolyte structure 20 is in direct physical contact with said porous substrate 19. Electrodes 21 and 22 are positioned on either side of the thin film solid electrolyte and in intimate contact therewith to provide effective electrical contact between the electrolyte and the electrodes.

The cell illustrated in FIG. 3 may be made by coating a porous alumina ceramic tube, for example, with a silver electrode by painting the electrode onto the alumina and sintering it at a temperatur of about 800° C. to form the finished electrode substrate combination. The electrode coated porous alumina tube may be then be dipped in an appropriate slip, that is, a water slurry of a particular oxide material such as one containing very minute particles of bismuth oxide to form a thin continuous film on the electrode coated substrate in a typical slip casting technique. After collecting a significantly thick coating of wet electrolyte ceramic oxide on the silver electrode substrate article, the complete article is fired to form a solid substantially non-porous, continuous thin film of sintered electrolyte onto the continuous silver electrode/porous ceramic substrate combination. A second electrode is then placed onto the exterior of the sintered electrolyte, which is then fired to form a completed article of the type illustrated in FIG. 3.

The advantage of the article illustrated in FIG. 3 is that the electrolyte is very thin so that a minimal distance exists between electrodes so that an oxygen ion migrating from one electrode to another has a very short distance to go. From an overall electrical circuit standpoint, a thin electrolyte creates less electrical resistance than a thicker electrolyte. Thin electrolytes are electrically efficient as well as being thermally efficient. Electrolytes such as zirconia, hafnia, ceria and bismuth oxide are more ion conductive, i.e., transport oxygen ions as a faster rate per unit area at elevated temperatures than they are at lower temperatures. For example, it is generally desired to operate a zirconia electrolyte based oxygen generating system at a temperature of at least about 500° degrees celsius and preferably above about 700° to 800° C. to achieve efficient operation. Bismuth oxide electrolytes operate efficiently at lower temperatures than zirconia, for example, oxygen ion transport rate for bismuth oxide at about 500 CC is equivalent to that of zirconia at about 800° C. for the same area of wall thickness of the electrolytes. Thin-walled electrolytes do provide significant advantages to an oxygen delivery system electro-chemical cells of the type described herein.

The thickness of the electrolyte wall for a cell such as that illustrated in FIG. 3 may be from about 20 micron to about 100 micron. In comparison a electrolyte thickness of a cell of the types illustrated in FIGS. 1 & 2 wherein the electrolyte is made by pressing of a dry material and then subsequent firing to a self-supporting structural shape is generally in the order of about 0.5 millimeters to about 2.0 millimeters.

In a device such as that illustrated in FIG. 3 the ceramic substrate must have a significant porosity and preferably be as thin as possible so that air or oxygen migrates readily through the porous ceramic substrate inasmuch as the porous ceramic substrate is either adjacent the cathode or the anode. Thus, the interior of the ceramic substrate tube may be a chamber from which oxygen is evacuated or into which air is introduced.

A thin electrolyte may be formed by plasma or flame spraying of very small particles of zirconia, hafnia, ceria or bismuth oxide onto an appropriate substrate, and electrode coated porous ceramic substrate. Although the particles achieve a very high temperature and very high velocities, the gross energy content of the particles is relatively low because of the small size of the particles. Thus, very hot particles may be sprayed upon a silver electrode which has a melting point of about 900° C. without causing substantial melting of the electrode.

A very thin, substantially continuous substantially non-porous electrolyte may be formed by plasma and flame spraying techniques. The zirconia, hafnia, ceria and bismuth oxide particles may be very pure or may contain dopants such as yttria, yterbia, calcia and the like to improve strength, toughness or electrical properties such dopants usually are present in minor quantities, e.g., less than about 10% by weight. Other materials may be incorporated in the electrolytes to act as fluxes to lower the sintering temperature of the material.

In making electrolyte assemblies to be utilized in oxygen generating devices for medical applications it is generally not necessary that 100% pure oxygen be obtained. Thus, the electrolyte and electrodes need not be prepared with such care that no pores exist in the electrolyte assembly. If some air leakage occurs in medical oxygen generating device, the device is still very useful. In medical devices, if the oxygen content of air can be increased from about 21% to 50% and especially to about 80% then further enhancement is generally not required. In fact, pure 100% oxygen is generally diluted with some air when oxygen therapy is provided to a patient.

From the standpoint of electrical efficiency, it is generally desired that the porosity of the electrodes and electrolytes be maintained fairly low. Pores in electrodes cause the sheet resistance to increase inasmuch as electron flow must take circuitous paths. Also, pores in the electrode, or electrolyte, diminish the effective electrode-electrolyte interface area, further decreasing electrical efficiency. If, however, the electrolyte wall thickness may be made very thin, less than about 10 micron, then the effects of some porosity of the electrolyte will be offset by the very short path of travel for oxygen ions migrating from one electrolyte surface to the other.

Thin continuous substantially non-porous electrodes of substantially uniform thickness are preferred. Electrodes of silver and silver alloys may be applied as conventional liquid formulation to electrolytes, or in the case of devices of the type illustrated in FIG. 3 to substrate support surface such as a porous ceramic or metal. These liquid formulations are then dried and sintered according to conventional techniques. Such coating methods are effective, however, the electrode coatings are relatively thick, eight microns to about 50 microns and relatively non-uniform in thickness.

Very thin silver and silver alloy electrodes which are substantially uniform in thickness may be obtained by sputtering or vapor deposition techniques. Electrode coatings of a thickness of about four microns to 30 microns which are substantially continuous and non-porous are readily achieved by sputtering or vapor deposition.

A device of the type illustrated in FIG. 1 employing a pressed and sintered zirconia electrolyte tube with one closed end having a wall thickness of about 1.0 millimeter was coated on each surface with a silver electrode by painting and firing of a liquid silver coating formulation. The electrodes were continuous, substantially non-porous and with a thickness of about 8 microns.

This device was operated in a furnace such that the temperature of the device was about 800° C. A voltage of about 1.0 volts at current of about 5 amps produced essentially pure oxygen at a rate of about one liter per hour.

In contrast a similar device with a similarly sized zirconia tube and with porous platinum electrodes of about the same area and thickness when operated at approximately the same temperature, voltage etc. produced oxygen at a rate of about 200 C.C./hr.

I claim:

1. An electrolyte assembly for an electrochemical oxygen generation device comprising:

an electrolyte comprising zirconia, hafnia, ceria or bismuth oxide, said electrolyte having a pair of opposed surfaces with a relatively thin wall of electrolyte separating said opposed surfaces;

a pair of substantially continuous, substantially non-porous, substantially sintered, thin electrodes permeable to oxygen molecules covering a substantial portion of said electrolyte opposed surfaces, said electrodes comprised of silver or a silver alloy having a substantial silver content.

2. The electrolyte assembly of claim 1 wherein said electrolyte has a wall thickness of from about 0.5 millimeters to about 2.0 millimeters.

3. The electrolyte assembly of claim 1 wherein said electrolyte is zirconia.

4. The electrolyte assembly of claim 1 wherein said electrolyte is bismuth oxide.

5. The electrolyte assembly of claim 1 wherein said electrodes contain at least about 50% silver.

6. The electrolyte assembly of claim 1 wherein said electrodes are opposed electrolyte surfaces are substantially coextensive.

7. The electrolyte assembly of claim 1 wherein said electrodes are at least about one micron in thickness.

8. The electrolyte assembly of claim 7 wherein said electrodes have a thickness of about six microns to about 20 microns.

9. The electrolyte assembly of claim 1 wherein each of said electrodes have a substantially uniform thickness.

10. The electrolyte assembly of claim 1 wherein said electrodes are substantially the same in thickness.

* * * * *